US005269130A

United States Patent [19]

Finckh et al.

[11] Patent Number: 5,269,130

[45] Date of Patent: Dec. 14, 1993

[54] METHOD FOR OPERATING A GAS AND STEAM TURBINE PLANT AND GAS AND STEAM TURBINE PLANT OPERATED ACCORDING TO THE METHOD

[75] Inventors: Hermann Finckh, Nürnberg; Hermann Brückner, Uttenreuth, both of Fed. Rep. of Germany

[73] Assignee: Siemens Aktiengesellschaft, Munich, Fed. Rep. of Germany

[21] Appl. No.: 889,506

[22] Filed: May 27, 1992

[30] Foreign Application Priority Data

May 27, 1991 [DE] Fed. Rep. of Germany ..... 4117313

[51] Int. Cl.[5] ..... F02G 3/00

[52] U.S. Cl. ..... 60/39.02; 60/39.182; 122/451 S

[58] Field of Search ..... 60/39.02, 39.03, 39.182; 122/451 S, 451 R

[56] References Cited

U.S. PATENT DOCUMENTS

| | | | |
|---|---|---|---|
| 3,331,202 | 7/1967 | Brunner | 60/39.182 X |
| 3,992,876 | 11/1976 | Aguet | 60/39.182 |
| 4,250,704 | 2/1981 | Bruckner et al. | 60/39.182 |
| 4,253,300 | 3/1981 | Willyoung | 60/39.182 |
| 4,288,979 | 9/1981 | Liljedahl et al. | 60/39.182 |
| 4,465,027 | 8/1984 | Steinegger | 122/451 R |
| 4,841,722 | 6/1989 | Bjorge | 60/39.182 |
| 5,069,685 | 12/1991 | Bisset et al. | 60/39.182 |

*Primary Examiner*—Richard A. Bertsch
*Assistant Examiner*—Michael I. Kocharov
*Attorney, Agent, or Firm*—Herbert L. Lerner; Laurence A. Greenberg

[57] ABSTRACT

A gas and steam turbine plant has a gas turbine producing exhaust gas, a water-steam loop in which water is preheated at a given high pressure and subsequently evaporated, a steam turbine in the water-steam loop, and a steam generator through which the exhaust gas flows for generating steam for the steam turbine. The steam generator has at least one preheater connected to the water-steam loop and a high-pressure heater connected downstream of at least one preheater. The water-steam loop has a partial loop connected parallel to the at least one preheater outside the steam generator for carrying an adjustable throughput quantity. A heat exchanger is disposed in the steam generator in the vicinity of the at least one preheater for removing usable heat. A method for operating the plant includes preheating a partial quantity of the water to be preheated outside the steam generator at the given high pressure, and adjusting the partial quantity as a function of an available total water quantity and admixing the partial quantity with the water preheated in the steam generator.

3 Claims, 1 Drawing Sheet

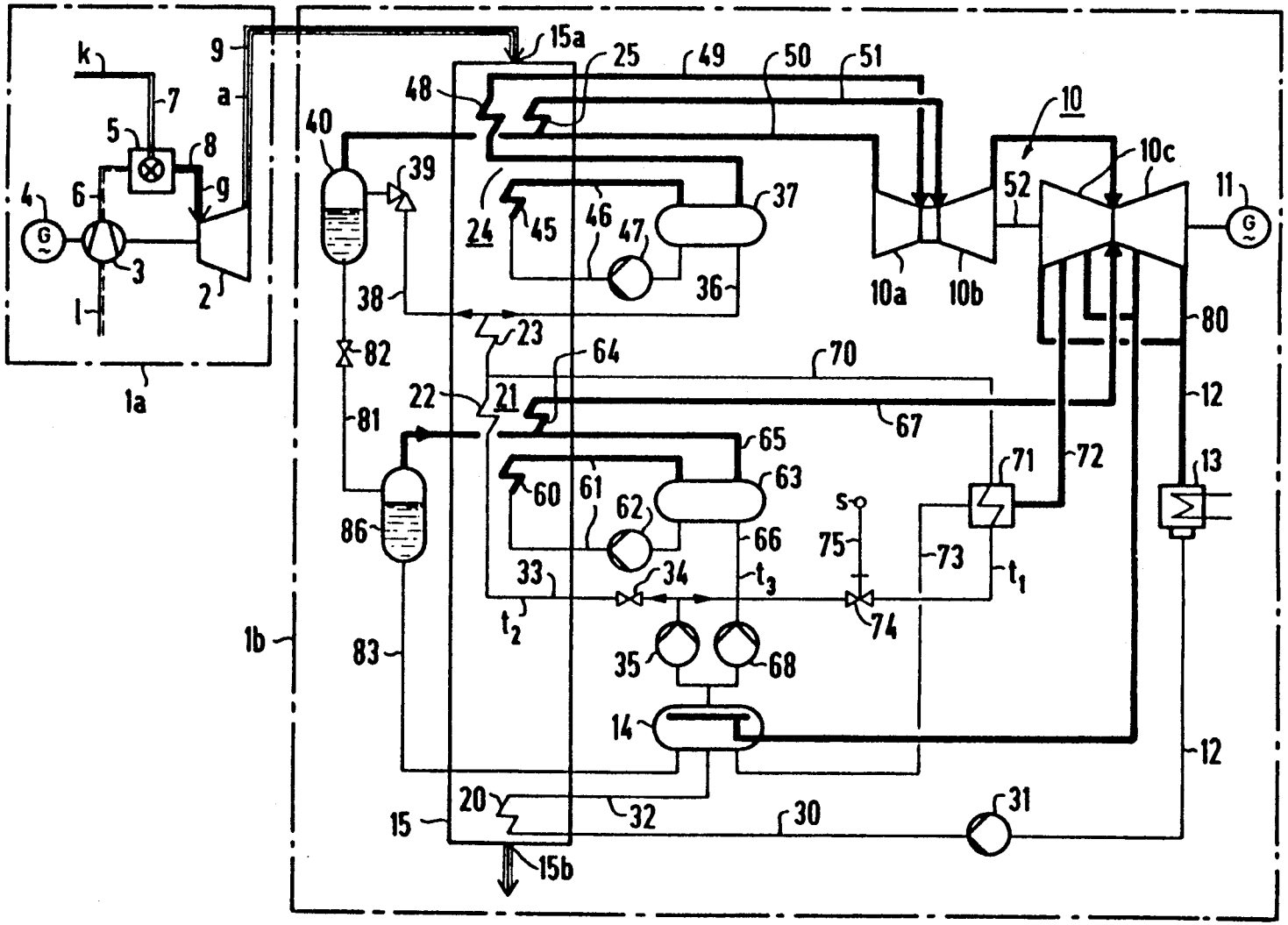
10
10a
10b
10c
11
12
13
14
15
15a
15b
20
21
22
23
24
25
30
31
32
33
34
35
36
37
38
39
40
45
46
47
48
49
50
51
52
60
61
62
63
64
65
66
67
68
70
71
72
73
74
75
80
81
82
83
86
1a
1b
2
3
4
5
6
7
8
9
a
k
l
s
$t_1$
$t_2$
$t_3$

METHOD FOR OPERATING A GAS AND STEAM TURBINE PLANT AND GAS AND STEAM TURBINE PLANT OPERATED ACCORDING TO THE METHOD

The invention relates to a method for operating a gas and steam turbine plant, with a steam generator through which exhaust gas from a gas turbine flows, for generating steam for a steam turbine in a water-steam loop. It is also directed to a gas and steam turbine plant operated according to the method.

In a gas and steam turbine plant, the quantity of heat contained in the gas turbine exhaust gas is utilized to produce steam for the steam turbine. The water-steam loop of the steam turbine typically includes two pressure stages, each made up of both a preheater and an evaporator and a superheater. In order to convert the highest possible proportion of the quantity of heat contained in the gas turbine exhaust gas, an intermediate superheater for re-superheating the steam leaving the high-pressure part of the steam turbine is typically also provided in the steam generator, and a condensate preheater is typically provided in order to heat the condensed steam from the steam turbine. When the temperature of the exhaust gas entering the steam generator is high and when there is a large total quantity of water available in the water-steam loop, especially low temperatures of the exhaust gas leaving the steam generator are attained. That means that the efficiency of the plant is especially high in the full-load range. That is true especially when the steam generator is also operated with supplementary firing.

However, in the operation of such a plant, the quantity of heat introduced into the steam generator varies in different operating states. Particularly in the partial-load range, because of a reduction in the flame temperature in a steam generator with supplementary firing, or as the result of a reduction in output of the gas turbine, the quantity of heat introduced into the steam generator is lowered even if the flow rate of the exhaust gases of the gas turbine remains approximately constant. The resultant reduction in the steam quantity produced causes a disproportionate reduction in the available total water quantity or feedwater flow, so that the temperature of the exhaust gases leaving the steam generator rises. As a result, the efficiency of the plant in the partial-load range is lower than in the full-load range, and therefore the total efficiency of the plant is limited.

It is accordingly an object of the invention to provide a method for operating a gas and steam turbine plant and a gas and steam turbine plant operated according to the method, which overcome the hereinafore-mentioned disadvantages of the heretofore-known methods and devices of this general type and which do so in such a way that the highest possible overall efficiency is attained in all of the operating states, including the partial-load range in particular.

With the foregoing and other objects in view there is provided, in accordance with the invention, a method for operating a gas and steam turbine plant having a gas turbine producing exhaust gas, a water-steam loop in which water is preheated at a given high pressure and subsequently evaporated, a steam turbine in the water-steam loop, and a steam generator through which the exhaust gas flows for generating steam for the steam turbine, which comprises preheating a partial quantity of the water to be preheated outside the steam generator at the given high pressure, and adjusting the partial quantity as a function of an available total water quantity at any given time and admixing the partial quantity with the water preheated in the steam generator. This creates a heat reservoir in the steam generator, with a heat quantity that is approximately constant in all of the operating states.

In accordance with another mode of the invention, with the heat quantity or heat output available in this heat reservoir, there is provided a method which comprises evaporating a further partial quantity of the water at low pressure in the steam generator and admixing it with the low-pressure steam flowing to a low-pressure part of the steam turbine. As a result, steam for the steam turbine is additionally produced, regardless of the load range or operating state of the plant.

In accordance with a further mode of the invention, there is provided a method which comprises preheating the adjustable partial quantity with steam from the steam turbine, in an indirect heat exchange. This enables preheating of the adjustable partial quantity to a temperature that corresponds to the water preheated in the steam generator.

With the objects of the invention in view, there is also provided a gas and steam turbine plant, comprising a gas turbine producing exhaust gas, a steam turbine, a water-steam loop connected to the steam turbine, a steam generator through which the exhaust gas flows, the steam generator having at least one preheater connected to the water-steam loop and a high-pressure heater connected downstream of the at least one preheater, the water-steam loop having a partial loop connected parallel to the at least one preheater outside the steam generator for carrying an adjustable throughput quantity, and a heat exchanger disposed in the steam generator in the vicinity of the at least one preheater for removing or carrying away usable heat.

In accordance with another feature of the invention, the at least one preheater and the high-pressure heater are connected in a series circuit, the heat exchanger is a low-pressure heater disposed in the steam generator downstream of the high-pressure heater, as seen in flow direction of the exhaust gas, and the low-pressure heater is connected parallel to the series circuit.

In accordance with a further feature of the invention, the the throughput quantity of the partial loop can be regulated as a function of the quantity of heat supplied to the steam generator. With this regulation, the throughput quantity is reduced in each case to the extent that the total water quantity available decreases because of decreased steam production. The available regulating range should be set for a limit case, such as for a zero throughput quantity in the partial-load range.

In accordance with an added feature of the invention, in order to adjust the throughput quantity, a regulatable valve is incorporated into the partial loop.

In order for the temperature of the water to be preheated in the partial loop and the temperature of the preheater disposed in the steam generator to be adapted to one another, a heat exchanger through which an adjustable quantity of steam flows, is incorporated into the partial loop.

In accordance with an additional feature of the invention, the preheater disposed in the steam generator is followed by another or second preheater.

In that case, in accordance with yet another feature of the invention, the partial loop is suitably connected on the outlet side to the inlet to the other or second preheater.

In accordance with a concomitant feature of the invention, there are provided heating surfaces disposed in the steam generator downstream of the at least one preheater, as seen in flow direction of the exhaust gas, the heating surfaces having an outlet side connected to the at least one preheater and to the partial loop. This is done in order to permit additional cooling of the exhaust gases.

The advantages attained with the invention are in particular that as a result of an additional partial loop being incorporated into the water-steam loop of the steam turbine and having an adjustable throughput quantity, a heat reservoir is created in the steam generator. Regardless of the operating state of the plant, on one hand this reservoir enables an additional steam production and on the other hand, in all of the load ranges, it enables a lowering of the temperature of the exhaust gases leaving the steam generator to the low value attainable in the full-load range. The result is high overall plant efficiency.

Other features which are considered as characteristic for the invention are set forth in the appended claims.

Although the invention is illustrated and described herein as embodied in a method for operating a gas and steam turbine plant and a gas and steam turbine plant operated according to the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with accompanying drawing.

The drawing is a schematic circuit diagram illustrating the way in which a partial loop according to the invention is disposed in and incorporated into a water-steam loop of a steam turbine of a gas and steam turbine plant.

Referring now to the single FIGURE of the drawing in detail, there is seen a gas and steam turbine plant which includes a gas turbine plant 1*a* and a steam turbine plant 1*b*. The gas turbine plant 1*a* includes a gas turbine 2 with an air compressor 3 coupled thereto, a generator 4 and a combustion chamber 5 which is upstream of the gas turbine 2 and is connected to a fresh air line 6 of the air compressor 3.

The steam turbine plant 1*b* includes a steam turbine 10 with a generator 11 coupled thereto and a water-steam loop 12 having a condenser 13 downstream of the steam turbine 10, a feedwater tank 14 downstream of the condenser 13, and a steam generator 15.

In order to deliver exhaust gases a from the gas turbine 2 to the steam generator 15, an exhaust gas line 9 is connected to an inlet 15*a* of the steam generator 15. The exhaust gas a leaves the steam generator 15 through an outlet 15*b* thereof in the direction of a non-illustrated chimney.

The steam generator 15 includes a condensate preheater or preheating surfaces 20, a low-pressure heater 21, first and second series-connected preheaters 22 and 23, a high-pressure heater 24, and an intermediate superheater 25.

The condensate preheater 20 has an inlet side which is connected to the condenser 13 over a line 30 that incorporates a condensate pump 31, and an outlet side which is connected to the feedwater tank 14 over a line 32.

The first preheater 22 has an inlet side which is connected over a line 33, that incorporates a valve 34, to a high-pressure pump 35, that communicates with the feedwater tank 14.

The second preheater 23, which is downstream of the first preheater 22, has an outlet side that is connected over a first branch 36 to a water-steam tank 37 of the high-pressure heater 24. The second preheater 23 is also connected over a second branch 38, which incorporates a corner valve 39, to a water-steam separating vessel 40.

The high-pressure heater 24 includes an evaporator 45, which is connected to the water-steam tank 37 through a circulation line 46. A pump 47 is incorporated into the circulation line 46. The high-pressure heater 24 also includes a superheater 48, which has an inlet side that is connected to the water-steam tank 37 and an outlet side that is connected over a fresh steam line 49 to a high-pressure part 10*a* of the steam turbine 10. The high-pressure part 10*a* of the steam turbine 10 has an outlet side which is connected over a steam line 50 to both the intermediate superheater 25 and the water-steam separating vessel 40.

The intermediate superheater 25 has an outlet side which is connected to a medium-pressure part 10*b* of the steam turbine 10 over a steam line 51. The medium-pressure part 10*b* is followed by a low-pressure part 10*c* of the steam turbine 10. The turbine parts 10*a*, 10*b* and 10*c* of the steam turbine 10 drive the generator 11 with a common shaft 52.

The low-pressure heater 21 includes an evaporator 60, which is connected over a circulation line 61 having a pump 62, to a water-steam tank 63. The low-pressure heater 21 also includes a superheater 64, which has an inlet side that is connected over a steam line 65 to both the water-steam tank 63 and a water-steam separating vessel 86. The superheater 64 has an outlet side that is connected over a steam line 67 to the low-pressure part 10*c* of the steam turbine 10. The water-steam tank 63 is connected over a line 66 to the feedwater tank 14. A low-pressure pump 68 is incorporated into the line 66.

The water-steam loop 12 of the steam turbine 10 includes a partial loop 70, extending outside the steam generator 15. The preheater 22 disposed in the steam generator 15 is connected parallel to this partial loop. To this end, the partial loop 70 has an inlet side which is connected to the feedwater tank 14 through the high-pressure pump 35 and an outlet side which is connected to the preheater 22, in a region between the preheaters 22 and 23. A heat exchanger 71 is incorporated into the partial loop 70. The heat exchanger 71 has a primary side which communicates with the low-pressure part 10*c* of the steam turbine 10 over a steam line 72 and with the feedwater tank 14 over a water line 73. A regulating valve 74, to which a control signal s can be supplied over a signal line 75, is incorporated into the partial loop 70.

During operation of the gas and steam turbine plant 1, the combustion chamber 5 is supplied with coal k through a supply line 7, in a manner which is not shown in further detail. The coal k is burned in the combustion chamber 5 with condensed fresh air 1 from the air compressor 3. Hot flue gas g produced in the combustion is carried over a flue gas line 8 into the gas turbine 2, where it expands and in so doing drives the gas turbine 2, which in turn drives the air compressor 3 and the generator 4. The hot exhaust gases a emerging from the gas turbine are introduced over the hot exhaust gas line 9 into the steam generator 15, where they are used to generate steam for the steam turbine.

The steam emerging from the low-pressure part 10*c* of the steam turbine 10 is delivered over a steam line 80 to the condenser 13 and condenses there. Through the use of the pump 31, the condensate is pumped into the condensate preheater 20 and heated there. The heated condensate flows out of the condensate preheater 20 into the feedwater tank 14 over the line 32.

The feedwater from the feedwater tank 14 is pumped by the pump 35 into both the preheater 22 and the partial loop 70. A partial quantity $t_2$ that flows through the preheater 22 is adjustable with the valve 34. A partial or throughput quantity $t_1$ of the feedwater that flows through the partial loop 70 is set with the regulating valve 74 and is admixed with the feedwater preheated in the preheater 22. The partial quantity $t_1$ of the feedwater flowing in the partial loop 70 is preheated by indirect heat exchange with steam from the low-pressure part 10*c* of the steam turbine 10, to a temperature that corresponds to a partial quantity $t_2$ of the feedwater preheated in the preheater 22.

The preheated feedwater flows through the second preheater 23 and is carried through the line 36 into the water-steam tank 37 of the high-pressure heater 24. From there, the preheated feedwater collected in the water-steam tank 37 flows through the evaporator 45, which has been heated by the hot exhaust gas a, and is evaporated as a result. The steam separated in the water-steam tank 37 flows through the superheater 48, which is heated by the exhaust gas a. In the superheated state, at a pressure of approximately 110 bar, this steam is delivered through the fresh steam line 49 to the high-pressure part 10*a* of the steam turbine part 10. The steam, which is expanded in the high-pressure part 10*a*, flows at a pressure of approximately 30 bar through the intermediate superheater 25 and is then relieved or expanded to a pressure of approximately 3 bar in the medium-pressure part 10*b* of the steam turbine 10. Some of the steam expanded in the high-pressure part 10*a* flows as so-called wet steam through the steam line 50 into the water-steam separating vessel 40. There, the steam, which is still at a pressure of approximately 30 bar, is separated from the water. The water can be introduced into the water-steam separating vessel 86 over a line 81 in which a valve 82 is incorporated. The pressure in the water-steam separating vessel 86 is approximately 3 bar, so that the water flowing in through the line 81 evaporates immediately. The water that is separated out in the water-steam separating vessel 86 is delivered to the feedwater tank 14 over a line 83. The steam that is separated out in the water-steam separating vessel 86 is delivered to the low-pressure heater 21.

Another partial quantity $t_3$ of the feedwater is pumped out of the feedwater tank 14 by the low-pressure pump 68 into the water-steam tank 63 of the low-pressure heater 21. There, the feedwater is pumped by the pump 62 through the evaporator 60 and back again into the water-steam tank 63. The steam that is produced in the process is superheated, along with the steam emerging from the water-steam separating vessel 86, in the superheater 64, and is carried through the steam line 67 to the low-pressure part 10*c* of the steam turbine 10. There, the steam together with the steam flowing out of the medium-pressure part 10*b* is expanded and delivered to the condenser 13 through the steam line 80.

As a result of the partial loop 70 that is additionally provided in the water-steam loop 12 of the steam turbine 10 according to the invention, a heat reservoir is created in the region of the preheater 22 in the steam generator 15, which is constructed either as a steam generator with supplementary firing, in a manner which is not shown in detail herein, or as a purely waste-heat boiler, as is shown in the exemplary embodiment. This heat reservoir is advantageously used to produce steam for the low-pressure part 10*c* of the steam turbine 10. However, the heat reservoir may also be used, for instance, to produce steam for the medium-pressure part 10*b* of the steam turbine 10 or as an additional preheating stage.

The partial quantity $t_2$ of feedwater flowing through the preheater 22 disposed in the steam generator 15 is adjusted to the available water quantity in partial-load operation, so that the additionally available partial quantity $t_1$ in full-load operation is carried through the partial loop 70. In other words, the partial or throughput quantity $t_1$ of the partial loop 70 is adjusted in such a way that in all of the operating states, the partial quantity $t_2$ flowing through the preheater 22 is approximately constant. The throughput quantity $t_1$ flowing in the partial loop 70 is therefore suitably set as a function of the available total water quantity. A further suitable controlled variable is the quantity of heat introduced into the steam generator 15 with the exhaust gases a, and optionally with the flue gases additionally produced in the case of a steam generator with supplementary firing. The signal s corresponding to these controlled variables is supplied to the regulating valve 74 over the control line 75, in a manner which is not shown in detail.

In full-load operation, the partial or throughput quantity $t_1$ in the partial loop 70 amounts to approximately 30 to 50%, and preferably 40%, of the total water quantity. In the case of a steam generator with supplementary firing, as the load decreases the supplementary firing is reduced first. It is only then, as a further provision, that the output of the gas turbine 2 is lowered. If a purely waste-heat boiler is used as the steam generator 15, then if the load decreases, the output of the gas turbine 2 is decreased immediately. In both cases, the quantity of heat introduced into the steam generator 15 drops, so that the total available quantity of feedwater decreases because of the reduced steam production.

With the incorporation of the partial loop 70 according to the invention, it is possible for the partial quantity $t_2$ flowing through the preheater 22 in the steam generator 15 to remain constant over a wide load range, or in other words in both full-load and partial-load operation, even though the total feedwater quantity has decreased. With decreasing load, the regulating valve 74 is continuously closed. At the same time, the quantity of steam supplied to the primary side of the heat exchanger 71 is reduced down to zero in the partial-load range. This provision has the effect of causing the low-pressure heater 21 to produce steam continuously, so that over the entire load range, the temperature of the exhaust gases a downstream of the evaporator 60 remains approximately constant. The overall advantage of this is that both with a steam generator 15 with supplementary firing and with a steam generator 15 constructed as a waste-heat boiler, in all of the operating states of the plant, optimal utilization of the quantity of heat introduced into the steam generator 15, with a simultaneously low temperature of the exhaust gases a leaving the steam generator 15, is possible.

We claim:

1. A method for operating a gas and steam turbine plant having a gas turbine producing exhaust gas, a water-steam loop in which water is preheated at a given high pressure and subsequently evaporated, a steam turbine in the water-steam loop, and a steam generator through which the exhaust gas flows for generating steam for the steam turbine, which comprises:

preheating a partial quantity of the water to be preheated outside the steam generator at the given high pressure, and adjusting the partial quantity as a function of an available total water quantity and admixing the partial quantity with the water preheated in the steam generator.

2. The method according to claim 1, which comprises preheating the adjustable partial quantity in indirect heat exchange with steam from the steam turbine.

3. The method according to claim 1, which comprises producing low-pressure steam and feeding the low pressure steam to a low-pressure part of the steam turbine, evaporating a further partial quantity of water of the water-steam loop at low pressure in the steam generator and admixing the further partial quantity with the low-pressure steam flowing to the low-pressure part of the steam turbine.

* * * * *